US005755650A

United States Patent [19]

Urso

[11] Patent Number: 5,755,650

[45] Date of Patent: May 26, 1998

[54] HOME AND OFFICE HEALTH AND FITNESS CHAIR

[76] Inventor: Charles L. Urso, 54 Marivista Av., P.O. Box 1136, Waltham, Mass. 02254

[21] Appl. No.: 555,302

[22] Filed: Nov. 8, 1995

[51] Int. Cl.[6] ..... A63B 21/00; A47C 7/54

[52] U.S. Cl. ..... 482/138; 482/92; 482/112; 482/139; 482/142; 297/115; 297/183.9; 297/411.35; 248/118

[58] Field of Search ..... 482/92, 111, 112, 482/142, 133–139, 904, 44; 297/115–117, 411.35, 411.37, 411.38, 183.9, 411.33, 411.34; 248/118, 118.1, 118.5, 118.3; 601/23, 24, 33; 188/290, 293, 296

[56] References Cited

U.S. PATENT DOCUMENTS

| | | | |
|---|---|---|---|
| 1,149,938 | 8/1915 | Nagelvoort | 188/290 |
| 1,279,120 | 9/1918 | Kellogg . | |
| 1,706,634 | 3/1929 | Seils . | |
| 2,055,297 | 9/1936 | Lane | 188/296 |
| 2,732,269 | 1/1956 | Astroff . | |
| 2,750,009 | 6/1956 | Pohl | 188/290 |
| 2,832,334 | 4/1958 | Whitelaw | 601/33 |
| 3,124,328 | 3/1964 | Kortsch . | |
| 3,494,616 | 2/1970 | Parsons | 482/58 |
| 3,528,413 | 9/1970 | Aydt . | |
| 3,572,700 | 3/1971 | Mastropaolo | 482/112 |
| 4,452,449 | 6/1984 | Propst | 482/41 |
| 4,469,325 | 9/1984 | Ware | 482/114 |
| 4,569,519 | 2/1986 | Mattox et al. | 482/114 |
| 4,629,185 | 12/1986 | Amann | 482/133 |
| 4,645,199 | 2/1987 | Bloemendaal | 482/58 |
| 4,730,829 | 3/1988 | Carlson | 482/137 |
| 4,741,529 | 5/1988 | Bloemendaal | 482/118 |
| 4,757,992 | 7/1988 | Heitsch et al. | 482/136 |
| 4,817,943 | 4/1989 | Pipasik | 482/137 |
| 4,838,547 | 6/1989 | Sterling | 482/128 |
| 4,913,393 | 4/1990 | Wood . | |
| 4,979,734 | 12/1990 | Sims | 482/112 |
| 5,038,758 | 8/1991 | Iams et al. | 482/57 |
| 5,044,633 | 9/1991 | Rice | 482/142 |
| 5,080,353 | 1/1992 | Tench | 482/138 |
| 5,143,422 | 9/1992 | Althofer et al. | 297/115 |
| 5,195,936 | 3/1993 | Mao | 482/112 |
| 5,380,269 | 1/1995 | Urso . | |
| 5,417,643 | 5/1995 | Taylor | 601/33 |
| 5,456,644 | 10/1995 | Hecox et al. | 482/137 |
| 5,470,298 | 11/1995 | Curtis | 482/138 |
| 5,486,150 | 1/1996 | Randolph | 482/137 |
| 5,571,274 | 11/1996 | Holstensson | 297/411.38 |

FOREIGN PATENT DOCUMENTS

| | | | |
|---|---|---|---|
| 653426 B | 3/1993 | Australia | 482/92 |
| 2045215 | 2/1971 | France | 482/139 |
| 2581550 | 11/1986 | France | 482/137 |

OTHER PUBLICATIONS

Nordictrack Nordicflex Gold Brochure.
WaterRower Inc. Brochure.

*Primary Examiner*—Richard J. Apley
*Assistant Examiner*—Victor K. Hwang

[57] ABSTRACT

A home and office health and fitness chair includes universally movable armrests (34) for supporting a user's arms and upper body weight while the user works. The armrests are mechanically supported to slide forward and rearward, move side-to-side, swivel about a vertical axis, tilt about two horizontal axes, and adjust laterally and vertically. They effortlessly follow the movement of a user's arms while typing on a keyboard or working a computer mouse. Each armrest comprises spaced hand grips (36); the combination being connectable to self-adjusting resistance devices (54, 100) for doing strength and fitness exercises. Having universal motion and orientation capabilities, the armrests/hand grips can be utilized for doing several different types of resistance workouts. The primary source of resistance is a fluid resistance reel (54) which includes an impeller (62) rotatably supported in a viscous liquid and surrounded by stators (70). Rotation of the impeller results in centrifugally driven liquid resistance. Also included in the chair are adjustable gravity resistance handles (102) for additional workouts. An alternative resistance reel (150) includes a generator (152) that generates usable electrical energy as the user exercises.

13 Claims, 4 Drawing Sheets

HOME AND OFFICE HEALTH AND FITNESS CHAIR

TECHNICAL FIELD

This invention relates to office chairs having ergonomic arm supports and to strength training systems and more particularly to a combination of both.

BACKGROUND

Personal computers are ubiquitous in the workplace and are broadly utilized in every type of gainful activity. As applications of the PC continue to expand, the number of manhours sitting at keyboards continues to increase.

The long hours, however, working computer keyboards have taken a toll in back ailments and repetitive motion injury. In the U.S., annual payout in medical costs and Workmans's Compensation is in multiples of tens of billions dollars and is growing; thus being a serious economic and health problem.

In general, low back pain is the second greatest cause for visits to doctors and accounts for the second largest amount of time off from work. With the exception of childbirth, back pain accounts for the greatest number of hospitalizations.

Back ailments frequently result from back muscles being too tense and abdominal muscles being too weak. This is a common condition with office workers, especially those that work at keyboards such as PC keyboards. While on the job, the center of weight of a keyboard user is normally forward. The imbalanced upper body weight causes compressive pressure on the lumbar disks to increase dramatically. Lower back muscles must pull continuously to prevent the worker from falling forward. Layers of abdominal muscles, which normally support the spine from the front, weaken from inadequate use. With upper body weight being off-axis from the spine, the tensed-up back muscles and ligaments are subject to producing pain.

Further complications often arise because the imbalanced muscle support makes the spine prone to accelerated wear and injury. Painful havoc can occur from irritation or injury to facet joints, discs, and root nerves, especially in the lumbar region. Recovery is often followed by recurrence.

In addition to the staggering expenditures for back pain, heavy costs are paid by Workman's Compensation for repetitive motion injury that causes pain in arms and wrists. Carpal tunnel syndrome is a common example associated with keyboard users.

The subject invention described herein provides a solution. It can help the user avoid pain and injury to the back, shoulders, arms, and wrists by a unique combination of arm and upper body support means and physical fitness devices; all built into an office chair, hereinafter referred to as the chair.

In a home environment, the chair provides as a compact strength training system for a variety of high quality workouts.

SUMMARY

The chair includes universally movable armrests for supporting a user's arms and upper body weight while the user works. The armrests are mechanically supported to slide forward and rearward, move side-to-side, swivel about a vertical axis, tilt about two horizontal axes, and adjust laterally and vertically. They effortlessly follow the movement of a user's arms while typing on a keyboard or working a computer mouse.

By being supported on the movable armrests as the user works, excessive pressure on the lumbar spine is avoided. Tension in the muscles and tendons of the back, shoulders, arms, and wrists is alleviated to avoid pain and injury, including repetitive motion disorders.

Each armrest comprises spaced hand grips; the combination being connectable to self-adjusting resistance devices for doing strength and fitness exercises. Having universal motion and orientation capabilities, the armrests/hand grips can be utilized for doing several different types of resistance workouts.

The primary source of resistance is a fluid resistance reel which includes an impeller rotatably supported in a viscous liquid and surrounded by stators. Rotation of the impeller results in centrifugally driven liquid (CDL) resistance, providing a glide sensation that is preferred over other methods of opposing motion.

Also included in the chair are adjustable gravity resistance handles for additional workouts. Hence, the chair can serve as a home or office gym. Workouts include:

(1) Lateral push-out exercises with hands on hand grips against CDL resistance.

(2) Lateral pull exercises with hands on hand grips against pneumatic resistance.

(3) Forward press exercises with hands on hand grips against CDL resistance.

(4) Triple positive resistance exercises with hands on hand grips in three mechanically guided directions.

(5) Lateral forearm press exercises with arms in elevated armrests tilted toward each other; resistance being CDL.

(6) Inward forearm press exercises with arms in elevated armrests tilted away from each other; resistance being pneumatic.

(7) Gravity resistance exercises with forearms in armrests adjusted to an upper position for doing knee-lifts, upper body lifts, and full body lifts.

(8) Gravity resistance exercises with hands on gravity resistance handles for doing knee-lifts, upper body lifts, and full body lifts.

(9) Shoulder rotation workouts with forearms in spring-loaded armrests.

(10) Wrist and forearm workouts with hands on spring-loaded hand grips tilted in selective positions.

Among the advantages of the chair is the prevention of conditions associated with prolonged keyboard use such as carpal tunnel syndrome and irritation or injury of facet joints, discs, and root nerves of the lower back. The chair strength training system helps in preventing the above-mentioned ailments and provides the myriad of benefits of strength conditioning.

Other advantages of the invention will become apparent from consideration of the drawings and ensuing description.

BRIEF DESCRIPTION OF THE DRAWINGS

The accompanying drawings in combination with the description herewith, illustrate features and advantages of the invention. Like reference numerals in different views refer to the same parts. The drawings are intended to illustrate principles of the invention and are not necessarily to scale and in which drawings.

DESCRIPTION OF THE INVENTION

Figure 1:
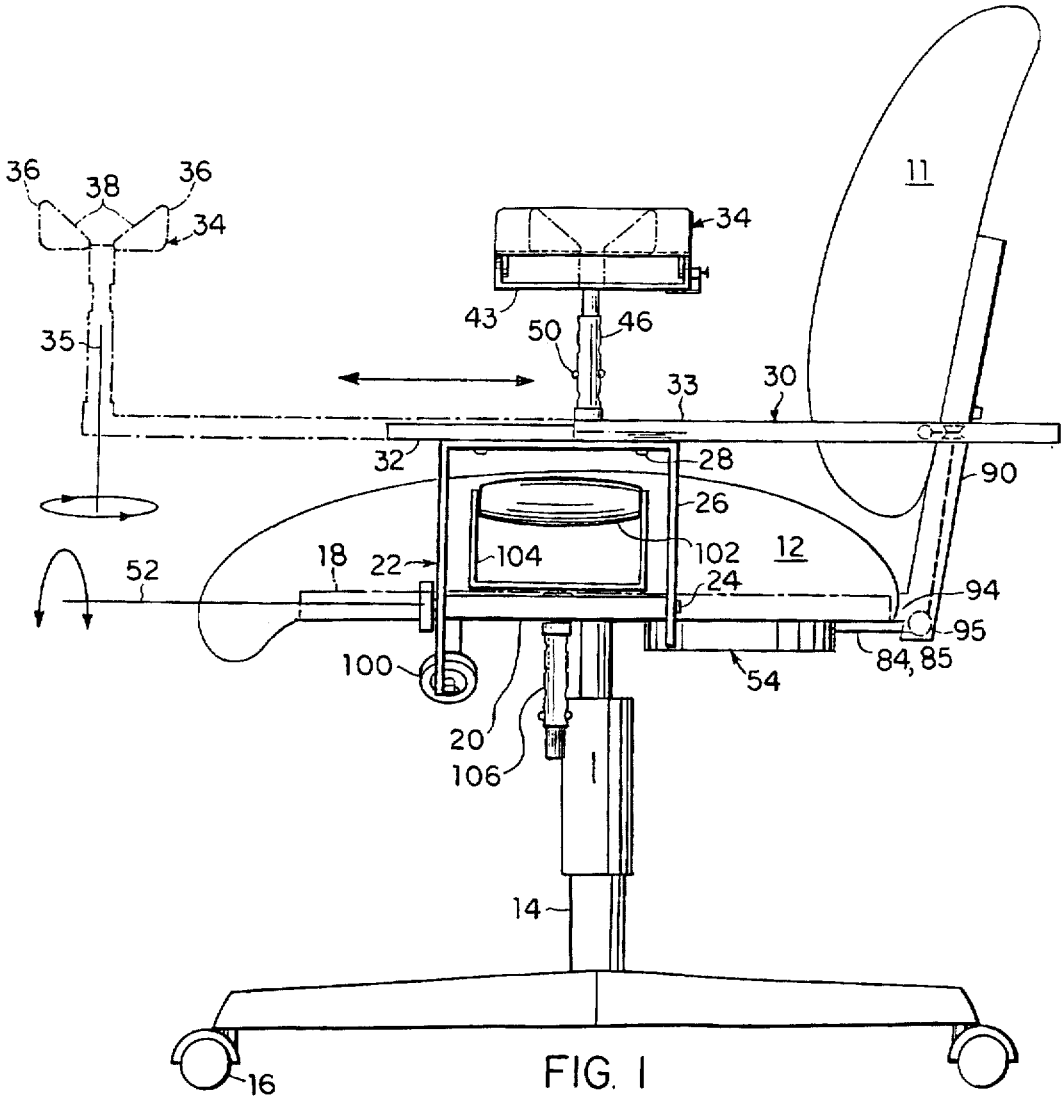
FIG. 1 is a left side view of an embodiment of the chair.

The chair embodying principles of the subject invention is shown in FIG. 1. Included is a seat 12 supported on a swivel stand 14 having wheels or rollers 16. The seat includes a rigid base 18 under an open cell foam cushion. A laterally adjustable slide element 20 is slidably supported within seat base 18 to adjustably extend from the left side of the base. A duplicate element (not shown) extends from the right side of the seat base. Full details of a similar seat base having similar laterally adjustable slide elements are provided in U.S. Pat. No. 5,380,269 issued Jan. 10, 1995 to this inventor.

Arm Supports

A left limb holder or arm support 22 is pivotally supported at an end portion of left element 20. A duplicate arm support (not shown) is similarly supported on the element at the right of the seat. Since the left and right arm supports are identical, the description will focus only on the left one.

The arm support includes a bracket 26 resembling an upsidedown U-shape. The bracket straddles element 20 and is pivotally mounted thereon by a pin 24 which passes through aligned bores in the bracket and the element. Pivotal motion of the arm support is about a horizontal first axis 52. A thumbnut mounted on a threaded end portion of pin 24 provides means for locking the arm support at selective positions.

Attached to the top of bracket 26 is a linear slide 30 directed forward of the seat. The slide includes a lower portion 32 fixed to bracket 26 with rivets 28. An upper portion 33 of the slide is slidably movable relative to the lower portion. Slide 30 is of conventional construction and includes ball bearings in linear races therein (not shown) to reduce friction.

Universally Movable Armrests/Hand Grips

Connected to the slide is a swivel mounted armrest 34. In the phantom depictions in FIG. 1, the armrest is rotated ninety degrees relative to the solid line depiction. The depictions also show forward and rearward positions to which the armrest can move horizontally by sliding with the slide.

Armrest 34 is a multipurpose device which comprises a pair of juxtaposed hand grips 36 (FIGS. 1, 2, and 3) spaced approximately 2 centimeters apart. Each grip 36 is elongated and sufficiently narrow to be surrounded by a user's hand. The space between the hand grips allows the user's fingers to wrap around either grip.

Both hand grips are symmetrical to each other. An end view or cross-section of each grip resembles a right triangle having three rounded corners rather than pointed corners. Each grip includes a broad sloped surface 38 which is inclined at approximately forty five degrees so that the sloped surfaces of the grips together define a valley for receiving a user's arm.

Within each hand grip is an elongated molded plastic core 39 (FIG. 2) which is shaped like a smaller version of the grip. Each core is enclosed in a urethane foam cushion 40. The hand grips are fixedly connected by a pair of short bridges 42 between respective end portions of the grips. Each bridge is fastened to the grip cores with fasteners or may be embedded therein when the cores are molded.

Figure 3:
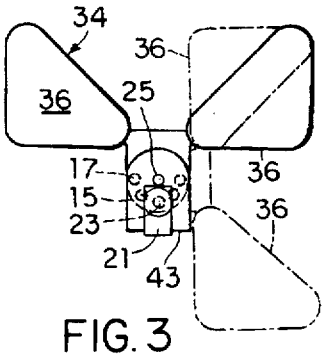
FIG. 3 is an end view of the armrest of FIG. 2.
Figure 9:
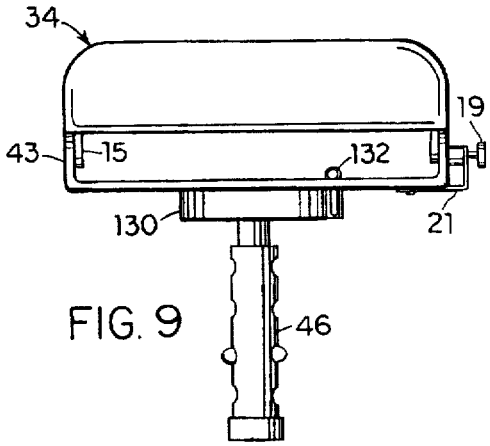
FIG. 9 is an isolated side view of the armrest and a swivel resisting torsion spring.

Fixed to a central edge portion of each bridge, and extending downward therefrom, is an ear-shaped lug 15 (FIGS. 3 and 9). The two lugs are pivotally supported between the two legs of a U-shaped steel bracket 43 and interface therewith, respectively.

Each lug pivots on a respective pin 25 received in aligned bores through the lug and corresponding bracket leg. Hence, the armrest/hand grips are pivotally supported to pivot or tilt about a horizontal second axis; the longitudinal axis of the armrest which passes through pins 25 and is parallel to the first axis.

Locking means is provided for releasably locking the armrest/hand grips at selective pivotal or tilt positions. The locking means comprises a series of bores 17 through a circumferential edge portion of lug 15, wherein the bores are equidistant from pin 25.

A pin holder 21 has a horizontal leg riveted to the bottom of bracket 43 and a vertical leg adjacent to a leg of bracket 43. Holder 21 includes a pin 23 (FIGS. 2 and 3) which is axially movable within a hollow cylinder positioned against the bracket leg. A spring 29, within the cylinder, is compressed against a piston flange 27 fixedly surrounding pin 23. The pin is urged by the spring to pass through a bore in the bracket leg and through one of the lug bores 17 which is aligned therewith. Thus, the armrest can be locked onto bracket 43 at a position that depends on which bore 17 is aligned with pin 23.

By pulling on a pin knob 19 (FIGS. 2 and 9), pin 23 will pull out of the bores to unlock the armrest. The armrest can then be pivotally moved to another position. Bores 17 are arranged on lug 15 such that a bore will align with pin 23 when the armrest is upright (solid line image), or when the armrest is tilted forty five or ninety degrees to either side of the bracket. One of the tilted positions is shown by the phantom image in FIG. 3. The armrest will be locked automatically when moved to any one of the mentioned positions as the spring urges pin 23 into the corresponding lug bore 17.

The base of bracket 43 is spaced from the hand grips so that the user's hand can wrap completely around either one of the grips.

Armrest Mount

Figure 2:
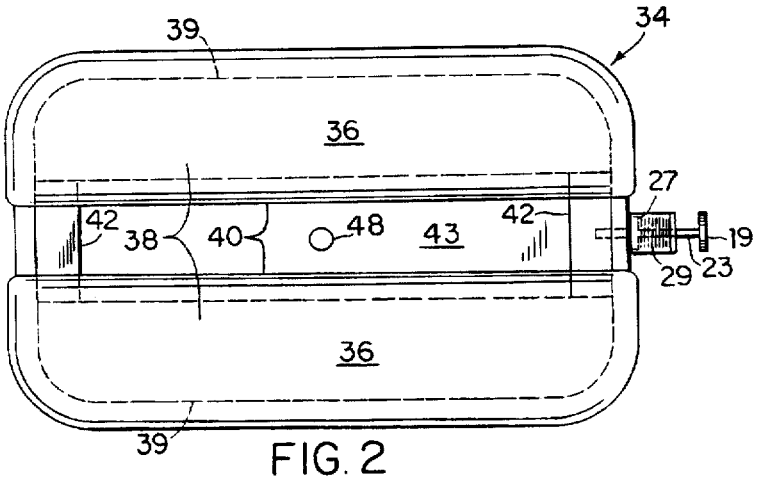
FIG. 2 is an isolated top view of an armrest.

The armrest and its bracket 43 is supported on a telescoping tubular mount 46 (FIG. 1). A bottom end of the mount is welded to slide portion 33. A top end of the mount is connected to the center of bracket 43 by a pin 48 (FIG. 2).

The pin is received in a bore in the bracket and is rotatably supported in the tubular mount. Hence armrest 34 can swivel about a vertical axis 35 (FIG. 1).

Mount 46 is comprised of a pair of tubes, one within the other, which can telescope to adjust the length of the mount. Rows of holes in the outer tube are provided to receive spring buttons 50 for quickly locking or releasing the telescoping tubes at selective positions relative to each other. Thus, the height of armrest 34 can be vertically adjusted. Further details of the locking means of mount 46 are excluded since the locking method is well-known.

In addition to the ability of the armrest to move forward and rearward on slide 30 and to swivel about a vertical axis, the armrest can also move laterally. Support 22 can pivot laterally about the horizontal axis 52 of pin 24, and can be laterally adjusted with slide element 20. As described, the armrest can be adjusted up and down by the adjusting mount 46.

Alternative Armrest Mount

Figure 4:
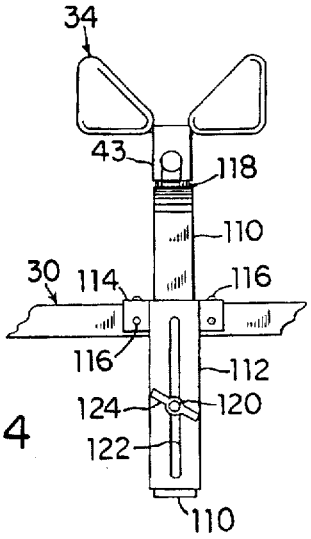
FIG. 4 is a fragmental side view of an alternative armrest mount.

An alternative mount for the armrest 34 is shown in FIG. 4. The mount includes a vertical steel bar 110 slidably supported in a sheath 112 to adjust vertically. The sheath is molded with a corner bracket 114 for mounting the sheath. The corner bracket is fixed to the top and side of slide 30 with rivets 116 such that the sheath hangs over the side of the slide.

An upper end portion of the bar 110 is bent over to a horizontal position directly above the slide. The armrest and its support bracket 43 is swivel mounted to the horizontal portion of the bar 110. The swivel mounting means includes a pin (not shown) received in aligned apertures through the center of bracket 43, through a ball bearing 118, and through the horizontal portion of the bar.

A screw 120 has an end fixedly received in a bore in bar 110 and the screw passes through a vertical slot 122 in sheath 112. A thumbnut 124 on the screw can be tightened to lock the bar at selective vertical positions in the sheath. Hence, the mount provides high strength and means for vertically adjusting the armrest.

Arm Support Summary

The armrests are cushioned with foam 40 for comfort. Anti-friction bearings, including the ball bearings in the slides allow the armrests to effortlessly follow the movement of the user's arms while typing on a keyboard or working a mouse. With arms and upper body weight being supported on the armrests, as the user works, pressure on the lumbar spine is relieved. Tension in the muscles and tendons of the back, arms, shoulders, and wrists is alleviated. Hence, repetitive motion disorders and back ailments associated with prolonged keyboard use including carpal tunnel syndrome and irritation or injury of facet joints, discs, and root nerves of the lower back can be avoided.

Strength Training System

The chair also provides means for doing a variety of strength and fitness exercises while on the job. In addition to keeping the user physically fit, the exercises play a role in preventing the above-mentioned ailments.

Fluid Resistance Reel

Figure 5:
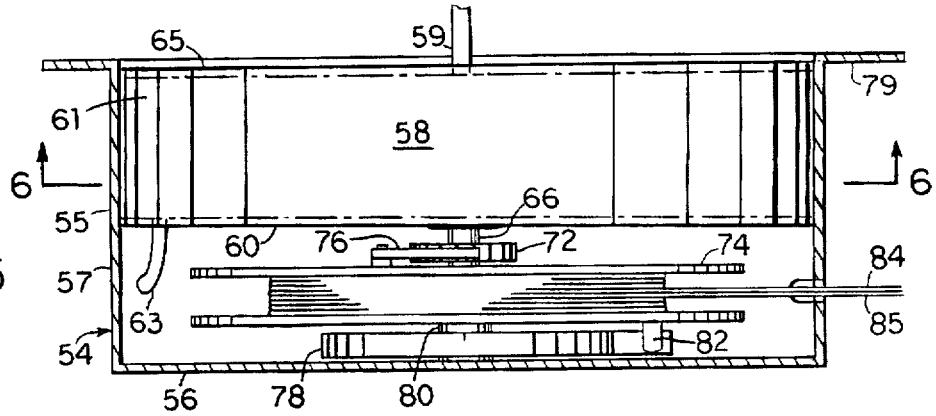
FIG. 5 is an isolated side view of a fluid resistance reel.
Figure 6:
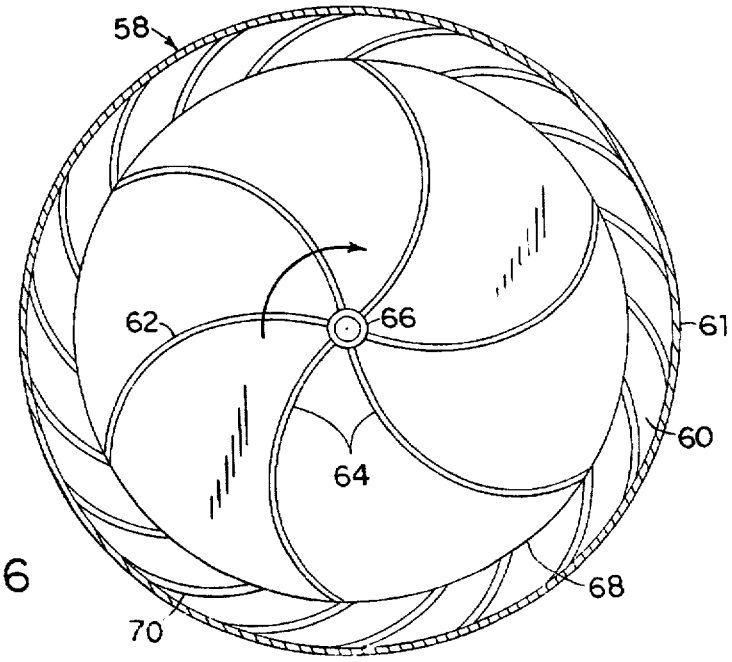
FIG. 6 is a sectional view of the fluid resistance reel taken horizontally along the line 6—6 of FIG. 5 without the exterior housing.

Shown in FIG. 1, under the s eat of the chair, is fluid resistance reel 54. Details of the reel are shown in FIGS. 5 and 6. Included is an outer housing 55 which is drum-shaped and has a flat bottom wall 56 and circular side wall 57. Within housing 55 is a slightly smaller drum-shaped housing of a centrifugal fluid resistor 58. The resistor housing includes a flat top wall 65, a flat bottom wall 60, and a circular side wall 61.

Contained in the resistor housing is a rotatably supported paddle wheel or impeller 62 (FIG. 6) having curved paddles or blades 64 affixed around a central shaft 66. The blades are rigidly supported by being attached to a disk 68 wherein the disk and blades are molded together as a unit. The shaft is rotatably supported in a conventional fluid sealed bearing (not shown) fixedly centered on the inside surface of wall 60. A central aperture in wall 60 allows a portion of shaft 66 to extend outside of the resistor housing.

Also contained in the resistor housing are stationary paddles or stators 70 surrounding the impeller. The stators are fixed to the inside surface of wall 61, such as by being molded together therewith. The stators are positioned and curved in opposite or opposing directions relative to the impeller blades and are close to, but not in contact with the latter.

During normal operation the resistor housing is at least partly filled with a viscous liquid, such as oil (not shown). If the impeller is rotated in the direction indicated by the arrow in FIG. 6, centrifugal force compels the liquid to move outward toward wall 61. At the same time, tangential force compels the liquid in a direction tangent to the impeller. The stators, however, resist tangential movement of the liquid and resulting pressure against the impeller blades resists rotation of the impeller. The faster the impeller is forced to rotate, the greater the resistance.

In FIG. 5, a ratchet wheel 72 is fixed to shaft 66 and a spool 74 is mounted on the shaft, but is not fixed thereon. The spool can, therefore, slip around the shaft without turning the latter. A pawl 76 is pivotally connected to the spool and is spring urged to contact the ratchet wheel.

A spiral spring 78 encircles a stationary post 80 which is fixed to wall 56 and to the inner end of spring 78. The outer end of spring 78 is attached to a tab 82 fixed to the spool.

The reel 54 is mounted in the chair seat by being inserted in an aperture in the seat base before the seat cushion is installed. A flange 79 extending from the reel housing rests on the seat base and is affixed thereon with screws (not shown). The seat cushion and preferred upholstery are then installed over the seat base and reel.

Two thin cables 84, 85 are wound on the reel spool and pass through an aperture in housing 55. Drawing the cables from the spool causes spring 78 to wind. At the same time, the pawl engages the ratchet wheel to rotate shaft 66 and the impeller in the resistance producing direction.

When the cables are released, spring 78 winds them back on the spool. The pawl rotates about the ratchet wheel in the opposite or non-engaging direction, so the impeller does not rotate and fluid resistance is not generated.

In an alternative arrangement, a double spool (not shown) in place of spool 74 would allow cables 84 and 85 to be wound separately.

Cable and Pulley System

Figure 7:
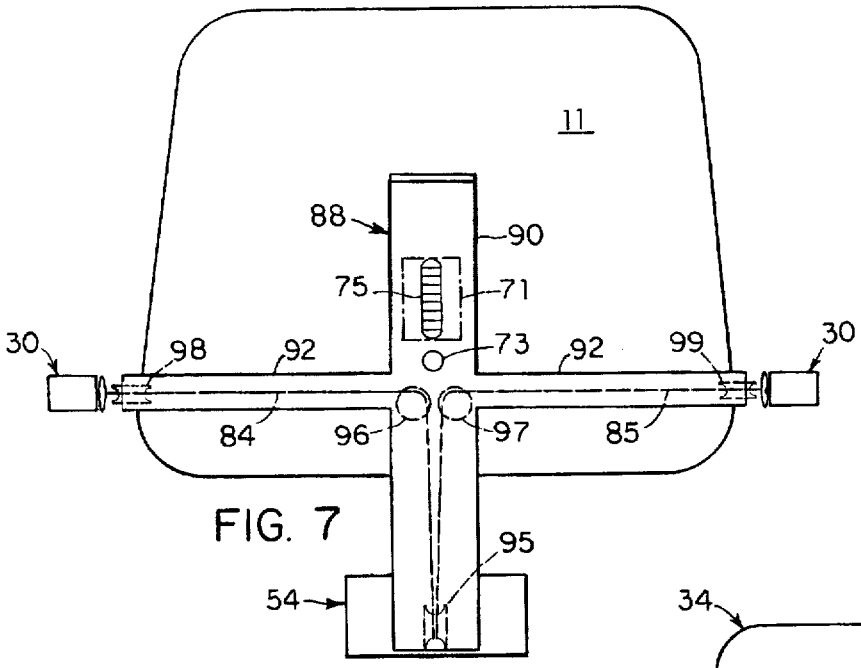
FIG. 7 is a back view, partially diagrammatic, of selected components of the chair of FIG. 1 indicating a cable and pulley system operatively connecting the selected components.

The resistance reel 54 is connected to the hand grips by a cable and pulley system at the rear of the seat (FIGS. 1 and 7). Included in the system is a cross-shaped support 88 comprised of a vertical pulley support or conduit 90 and a horizontal pulley support or conduit 92 welded together at the joint of the cross. Internal openings in cross joint allow internal access to both conduits. The horizontal conduit has a longitudinally open bottom.

A lower end portion of the vertical conduit includes a welded lug 94 which is fixed with bolts (not shown) to the seat base 18. An upper end portion of the vertical conduit supports a backrest 11 which is secured thereon in a conventional manner.

Hidden within the conduits are five pulleys 95, 96, 97, 98, 99 rotatably supported by pins (not shown) which pass through the conduit walls and through the hubs of the pulleys. The pulleys are arranged as indicated in the figures.

Lower pulley 95 is engaged by the two cables 84, 85 extending horizontally from the reel 54 and through an aperture in a lower end portion of conduit 90. Pulley 95 guides the cables upward inside conduit 90 where the two cables diverge and engage the two juxtaposed central pulleys 96, 97, respectively. The central pulleys guide the separated cables horizontally in opposite directions to move longitudinally within respective wings of the horizontal conduit 92. After passing through conduit 92, each cable is detachably connected to a respective slide 30. The connecting means is a conventional catch for quick attachment or release.

The pair of distal pulleys 98, 99 are positioned at distal ends of the horizontal conduit 92, respectively. Thus, the distal pulleys are positioned rear of the seat and laterally thereof. The cables engage and are guided by the distal pulleys, only when the hand grips (and therefore the slides) are pushed forward relative to the seat. Lateral and rearward motion of the grips does not cause cable engagement with the distal pulleys.

Additional Resistance Features

Pneumatic Resistance

Pull stroke resistance is provided by a conventional pneumatic resistance cylinder 100 as shown from an end view in FIG. 1. The cylinder is pivotally connected under seat base 18 with a conventional mounting bracket fastened to the underside of the base. A piston rod, extending axially from the cylinder, is pivotally connected to a lower end of bracket 26 which acts as a lever. A duplicate cylinder (not shown) is similarly connected to the right arm support.

As is conventional with a resistance cylinder, a valve (not shown) for regulating resistance can be adjusted from zero pounds to an upper limit. When the armrests are being used only for support (not in exercise mode) the resistance is set to zero.

Gravity Resistance

A set of adjustable left side and right side gravity resistance handles 102 (FIG. 1) is also incorporated in the system. They allow the user to do important back erector muscle stretches and exercises that strengthen and tone the muscles of the abdomen, back, shoulders, and arms.

Each handle is supported between the legs of a respective U-shaped bracket 104. Each bracket 104 is supported on a respective telescoping vertically adjustable mount 106 which adjusts like mount 46. Each mount 106 is fixedly received in an aperture though an end portion of a respective element 20.

Spring Resistance

A detachable feature is included that provides yielding resistance against the swivel motion of the armrests. As shown in FIG. 9, the device comprises a torsion spring 130 surrounding an upper end portion of mount 46. An inner end of the spring is attached by conventional means to the upper end portion of the mount tube. An outer hook-shaped end of the spring receives a cotter pin 132 which passes through a bore in bracket 43. The user inserts the pin when the resistance of spring 130 is to be actuated.

Resistance Range Control of the Fluid Resistance Reel

The range of resistance to rotation of the impeller can be increased by raising the level of the viscous liquid in the resistor housing. Conversely, lowering the level of liquid reduces the resistance range.

Figure 8:
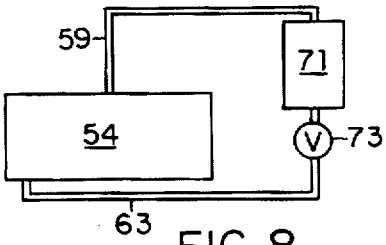
FIG. 8 diagrammatically shows a fluid loop by which fluid levels in the resistance reel of FIG. 5 can be adjusted for controlling resistance ranges.

Control of the liquid level, and therefore the resistance range, is achieved by the system shown in FIG. 8. A rectangular reservoir 71 is connected in fluid communication with the resistor housing within resistance reel 54 by way of flexible plastic tubes 59 and 63. Tube 59 conducts air between the reservoir and the resistor housing. Tube 63 conducts the viscous liquid between the reservoir and the resistor housing.

An end portion of tube 59 (FIG. 5) is fitted over a short nipple extending through the center of wall 65 of the resistor housing. An end portion of tube 63 passes through an aperture in wall 57 and is fitted over a short nipple extending through a peripheral portion of wall 60. Passage of liquid in tube 63 is controlled by a valve 73 (FIG. 8).

When the impeller rotates, pressure increases toward the periphery of the resistor housing and decreases in the center. If valve 73 is open as the impeller rotates, liquid is pumped from the resistor housing and enters the reservoir through tube 63. Air is sucked from the reservoir to replace the displaced liquid in the resistor housing through tube 59.

If valve 73 is opened when the impeller is not rotating, liquid from the higher positioned reservoir flows into the resistor. Air from the resistor flows into the reservoir.

Hence, the system operates as a closed circuit or loop and can be used to control the liquid level in the resistor and therefore the resistance range.

An upper portion of the vertical conduit (FIG. 7) contains the rectangular reservoir 71 mounted therein. The reservoir is made of clear or translucent plastic so the level of liquid contained therein can be seen through a vertical slot 75 in the conduit. Horizontal graduation marks on the reservoir allow the relative level of liquid to be determined. Lugs (not shown) extending from the reservoir provide the mounting means.

Mounted in the conduit, below the reservoir, is valve 73 having a control knob extending through an aperture in the conduit. The tubes attached to the reservoir (indicated in FIG. 8, but not in FIG. 7) pass down the inside of the conduit and exit from a lower end portion to connect with resistance reel 54.

Operation of the Resistance Range Control

The range of resistance provided by the resistance reel can be increased by opening valve 73 and allowing the viscous liquid to drain from the reservoir into the fluid resistor. A user can monitor the reservoir liquid level and close the valve when the preferred level is reached.

To decrease the reel resistance range, the user can open valve 73 and monitor the reservoir liquid level while moving slide 30. Slide motion drives the reel impeller and pumps liquid from the resistor into the reservoir when the valve is open. When a preferred liquid level is reached, the valve can be closed.

Operation of the Strength Training System

Exercise 1.

Figure 11:
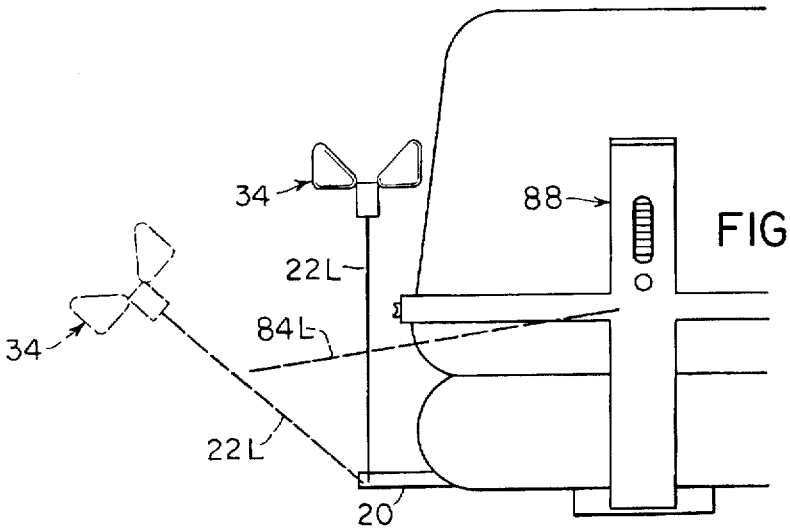
FIG. 11 is a diagrammatic back view indicating arrangement of armrests for lateral push and pull exercises.

With cables attached to the slides, lateral push-out exercise can be done by repetitions of pushing the hand grips laterally. The grips should be oriented as indicated in FIG. 11. They may be height adjusted and locked in the most comfortable and ergonomically suitable hand position for individual users.

The armrest/handgrips 34 can move between the positions indicated by the phantom and solid line images (FIG. 11) when pushed or pulled laterally. The longitudinal center line of the arm support (line 22L) indicates the pivotal angle at which the arm support would normally pivot.

When the hand grips are pushed laterally outward from the seat, the cables will tilt below the longitudinally open bottom of the horizontal conduit as indicated by line 84L. The cables are guided by pulleys 95, 96, and 97 (FIG. 7) as the cables are drawn out of reel 54 against the centrifugally driven liquid (CDL) resistance. On the return stroke, the cables return as the reel spring rewinds them onto the spool and draws the hand grips back to their "start" positions. The exercise cycle is then repeated for as many repetitions as desired by the user. Several muscles systems benefit by the resistance of reel 54 when the hand grips are pushed laterally.

Exercise 2.

Other muscles benefit by lateral pull strokes against the pneumatic resistance of cylinder 100. This may be done as a separate exercise by detaching the reel resistance of Exercise 1. Or, both exercises may be combined in a push-pull cycle by actuating both forms of resistance as double-positive.

For lateral pull stroke exercises, the hand grips may be height adjusted and locked in a position most comfortable for the user. The exercise may be done for as many repetitions as desired.

As described hereinbefore, arm support 22 may be locked at a selective pivotal position. In that case, lateral motion of armrest/hand grips 34 can be linear due to the linear lateral motion of slide 20. As described, armrest/hand grips 34 are mounted on guide means which includes first slide 30 which is movably supported on second slide 20 which is positioned transverse to slide 30. Hence, armrest/hand grips 34 can be moved against the CDL resistance of reel 54 in selective linear forward and linear lateral motions in an infinite number of paths in a common horizontal plane. This enables use of paths most natural to the user's arm motions.

Exercise 3.

Another exercise that can be done on the chair is a forward press exercise against the CDL resistance of reel 54. To do so, the hand grips would be oriented as indicated by the phantom depictions in FIG. 1. They may be height adjusted and tilted to a position most comfortable for the user. The user can push the hand grips forward of the seat with linear motion until his or her arms are straight (the slides become extended as indicated by the phantom depiction in FIG. 1). On the return stroke, the grips are drawn back to their start position. The exercise is repeated for as many repetitions as desired. Muscles of the arms, shoulders, and chest are strengthened and toned by the exercise.

When doing the forward press, the cables engage all five pulleys. With each return stroke, the reel spring rewinds the cables on the spool and draws the hand grips back to their start positions.

Exercise 4.

Triple positive resistance exercises, with hands on the hand grips, may be done by using a combination of the above-described workouts. Each cycle may include a forward push stroke, a return stroke, then a lateral push stroke followed by a pull return stroke. The hand grips move in three mechanically guided directions against positive resistance. Each positive resistance direction differing from the other two by multiples of ninety degrees.

Exercise 5.

Figure 12:
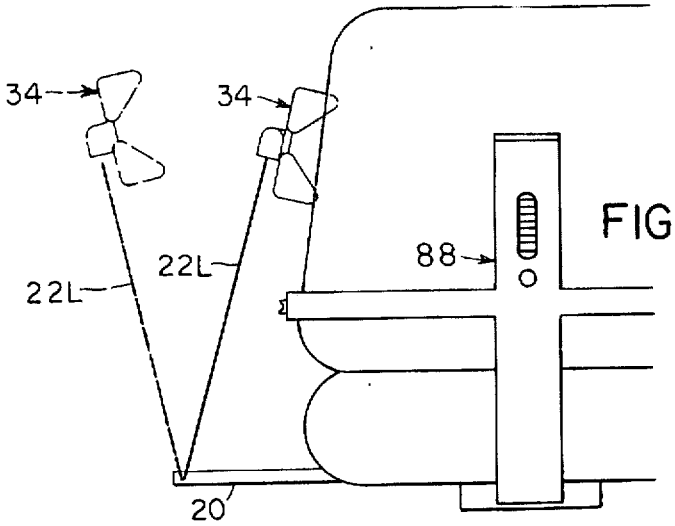
FIG. 12 is a diagrammatic back view indicating arrangement of armrests for lateral forearm presses.

Lateral forearm press exercises may be done by adjusting the armrests 34 and slide elements 20 to the positions indicated in FIG. 12. The armrests are elevated and tilted toward each other and the slide elements are extended. The phantom image shows the pivotal angle to which the arm support would normally pivot.

With forearms in the armrests, a user can press laterally outward against CDL resistance and then return them in a butterfly-like action with each repetition. As the user's arms spread laterally, the armrests pivot about the vertical and horizontal pivotal axes and move rearward on the slide.

Exercise 6.

Figure 13:
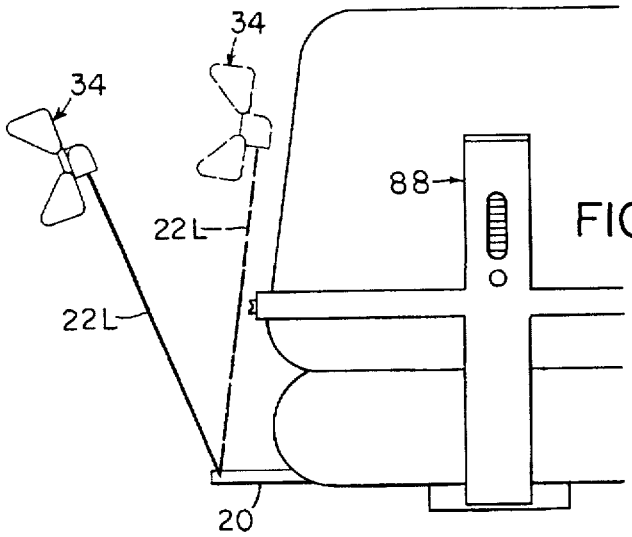
FIG. 13 is a diagrammatic back view indicating arrangement of armrests for inward forearm presses.

Inward forearm press exercises may be done by adjusting the armrests 34 and slide elements 20 to the positions indicated in FIG. 13. The armrests are elevated and tilted away from each other and the slide elements are partly retracted. The phantom image shows the pivotal angle to which the arm support would normally pivot.

With arms in the armrests a user can press against the pneumatic resistance, pressing the armrests inward with his or her forearms and then return them in a butterfly-like action with each repetition. During the inward stroke, the armrests pivot about the vertical and horizontal pivotal axes and move forward on the slide.

Exercise 7.

By actuating the resistance of spring 130, shoulder rotation workouts can be done by pivoting the armrests up to one hundred and twenty degrees against spring resistance with user forearms in the armrests.

Exercise 8.

Wrist and forearm workouts can be done by pivoting the armrests against the resistance of spring 130 with hands on the hand grips. The wrist and forearm workouts can be varied by doing them in each tilt position of the armrests/hand grips.

Exercise 9.

With upright armrests adjusted to an upper position, gravity resistance exercises can be done with user forearms in the armrests. Knee-lifts and body-lifts are done with feet off the floor. Upper body lifts may be done with feet on the floor.

Exercise 10.

Gravity resistance handles 102 can be vertically adjusted to suit the user. Knee-lifts and upper body lifts are among the exercises that may be done. The arm supports should be pivotally moved laterally out of the way when handles 102 are to be used.

An Alternative Resistance Reel

Figure 10:
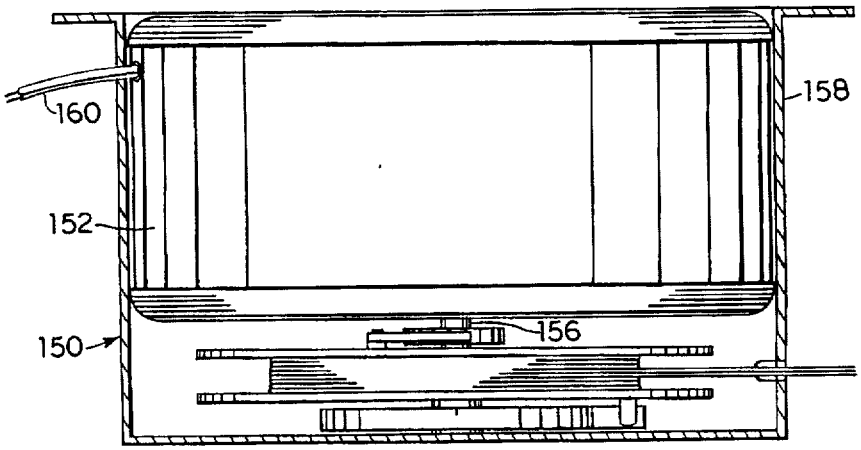
FIG. 10 is a sectional view of an alternative resistance reel.

FIG. 10 shows an alternative resistance reel 150 which could be used in place of resistance reel 54. The significant difference is that the resistance means is a conventional electric generator 152 instead of the centrifugal fluid resistor.

The generator produces electrical energy at the expense of mechanical work. When the armature (not shown) is rotated, coils of wire move across a magnetic field thereby inducing current in the wire. Current increases as the rotation rate increases (up to a limit). Rotation, however, is resisted by the magnetic field so that an increased force is required to increase the rotation rate. In other words, the resistance increases as the amount of applied force increases.

A generator shaft 156 is connected to similar reel components, and in the same manner, as the resistor shaft in the fluid resistance reel. A housing 158 encloses the generator and reel components. An electrical output cord 160 passing out of the generator may be connected to conventional means for using or storing the electrical output (not shown).

Where there are many chairs being used, such as in an office building, the electrical output could be wired to a central bank of storage batteries. Energy from the battery bank could be used to supplement the low power requirements of office equipment in the building.

Alternative Device of Changing Resistance Ranges

An alternative device for selectively changing resistance ranges may include a conventional planetary gear transmission (not shown). The transmission could connect the reel drive components to resistor 58 of reel 54 or to generator 152 of reel 150. In existing transmission models, gears can be shifted to a selectable gear ratio, to increase or decrease speed, simply by dialing the preferred ratio. If connected in the resistance drive system, as mentioned, a user could select resistance ranges by shifting gears.

A planetary gear transmission, as described, can be produced from molded components to be price competitive.

Conclusion

Except for spring 130, the resistance devices described herein produce exclusively positive resistance. The resistance increases as the degree of applied force increases and the resistance decreases as the applied force decreases. Thus, as the force exerted by the user changes throughout the length of an exercise stroke, the resistance adjusts accordingly (within range limits). This maximizes the benefits. The exercises are safer and greatly reduce the chance of trauma or injury to muscles and tendons.

As described, several different types of exercises can be done on the chair while on the job. All the described exercises help counteract the negative effects of repetitive and prolonged keyboard operation. In the process, they build, strengthen, and tone muscles, strengthen bones, improve appearance, and promote general health. Thus, a healthier, more productive work day and a physically fit body results.

Office keyboard devices include computers, word processors, typewriters, stenographs, etc.

The chair also serves as a compact home gym. A user can watch TV while doing high quality workouts. CDL resistance provides quiet, smooth, all-positive resistance; a painless method of strength training. The gliding "feel" of CDL resistance is preferred over that of springs, rubber bands, weights, or friction devices of conventional strength training systems.

The invention also provides a physical conditioning solution for the millions of people worldwide who must spend their day seated due to limited or no use of their legs. They include people with leg or spine injuries, birth defects, demyelinating conditions, amputations, diabetes, advanced age, etc. The chair provides means for selectively doing the exercise they need.

While the above description contains many specificities, these should not be construed as limitations on the scope of the invention, but rather as exemplifications of preferred embodiments. Those skilled in the art will envision other possible variations that are within its scope. Accordingly, the scope of the invention should not be determined by the embodiments illustrated, but by the appended claims and their legal equivalents.

What is claimed is:

1. An armrest, for an exercise device, comprising a pair of elongated hand grips and means for supporting the hand grips substantially parallel to each other and spaced so either grip can be surrounded by a user's hand, each grip having a sloped surface along its length such that the sloped surfaces of both grips together define an elongated valley open at opposite ends of the grips for holding a user's arm in the valley so the user can forcibly move the armrest with a selective limb portion in contact therewith.

2. The armrest of claim 1, further comprising a support having means for supporting the hand grips to pivot about first and second axes, and locking means for releasably locking the hand grips at selective pivotal positions about each of the axes.

3. The armrest of claim 1, further comprising a support having means for pivotally supporting the hand grips to swivel about a swivel axis that passes between the hand grips, and resistance means for yieldingly resisting swivel motion of the hand grips about said swivel axis.

4. A health and fitness system comprising:

seat means for supporting a user;

movably supported armrest connected to the seat means for movably supporting a user's arm on the armrest;

pivotal support means for supporting the armrest to pivot about a substantially horizontal first axis and to pivot about a second axis which is substantially parallel to the first axis;

locking means for releasably locking the armrest at selective pivotal positions; and resistance means, offering resistance and releasably connected to the armrest, for user exercise by moving the armrest against said resistance.

5. The health and fitness system of claim 4, wherein the second axis a longitudinal axis of the armrest in order for the armrest to be releasably locked at selective positions about the longitudinal axis.

6. The health and fitness system of claim 4, further comprising guide means, supporting the armrest, for selective linear lateral and linear forward motions, against said resistance, within a substantially horizontal common plane.

7. The health and fitness system of claim 4, wherein the armrest is substantially defined by a pair of elongated hand grips supported spaced in juxtaposition, each grip having a sloped surface along its length such that the sloped surfaces of both grips together define an elongated valley for holding the user's arm therein.

8. The health and fitness system of claim 4, wherein the armrest is substantially defined by a pair of narrow, spaced hand grips supported adjacent each other for holding a user's arm therebetween, each grip for being hand-moved against said resistance.

9. A health and fitness system comprising:

a hand grip;

a support having guide means for movably supporting and guiding the hand grip in selective linear forward and linear lateral motions along an infinite number of paths in a common plane; and resistance means, providing resistance, for yieldingly resisting linear forward and linear lateral motions of the hand grip so a user can exercise therewith.

10. The health and fitness system of claim 9, wherein said plane is substantially horizontal.

11. The health and fitness system of claim 9, wherein the guide means includes a first slide which is movably supported on a second slide positioned transverse to the first slide wherein the hand grip is movably supported on both slides for multi-dimensional linear motions against said resistance.

12. The health and fitness system of claim 9, further comprising the hand grip being incorporated in an armrest movably supported and guided by the guide means for movably supporting a user's arm against said resistance.

13. A health and fitness system comprising:

seat means for supporting a user;

a hand grip;

guide means, connected to the seat means, for movably supporting and guiding the hand grip to move linearly forward of the seat means;

resistance means, offering resistance, for user exercise by moving the grip against said resistance, the resistance means includes motion opposing means for resisting motion, a distal pulley rotatably supported rear of the seat means and laterally thereof, a cable having an end portion connected to the motion opposing means and an opposite end portion releasably connected to the hand grip, the cable being movably supported to engage the pulley when the hand grip is moved forward of the seat means and be disengaged from the pulley when the grip is moved laterally of the seat means; and means for pivotally supporting the grip to move laterally of the seat means against said resistance.

* * * * *